US008042281B1

(12) United States Patent
Estes et al.

(10) Patent No.: US 8,042,281 B1
(45) Date of Patent: Oct. 25, 2011

(54) HYPERBARIC CENTRIFUGE SYSTEM

(75) Inventors: Thomas P. Estes, Bristol, TN (US); Christopher R. Lambert, Telford, TN (US); Jeffrey D. Mongold, Jonesborough, TN (US); Charles B. Tate, Spartanburg, SC (US)

(73) Assignee: Decanter Machine, Inc., Johnson City, TN (US)

( * ) Notice: Subject to any disclaimer, the term of this patent is extended or adjusted under 35 U.S.C. 154(b) by 0 days.

(21) Appl. No.: 12/885,788

(22) Filed: Sep. 20, 2010

Related U.S. Application Data

(62) Division of application No. 12/114,972, filed on May 5, 2008, now Pat. No. 7,908,764.

(51) Int. Cl.
*F26B 5/08* (2006.01)
*F26B 17/20* (2006.01)

(52) U.S. Cl. ..... 34/312; 34/319; 34/320; 34/325; 34/328; 34/417; 494/38; 494/40

(58) Field of Classification Search ..... 34/312, 34/318, 319, 320, 325, 417, 58, 242; 494/38–41
See application file for complete search history.

(56) References Cited

U.S. PATENT DOCUMENTS

| | | | | |
|---|---|---|---|---|
| 3,194,492 | A | 7/1965 | Koffinke et al. | |
| 3,447,742 | A | 6/1969 | Eriksson et al. | |
| 3,729,128 | A * | 4/1973 | Reed | 494/38 |
| 3,784,091 | A * | 1/1974 | Hiller | 494/38 |
| 3,795,361 | A | 3/1974 | Lee | |
| 3,934,792 | A | 1/1976 | High et al. | |
| 4,245,777 | A | 1/1981 | Lavanchy | |
| 5,169,377 | A | 12/1992 | Schlip et al. | |
| 5,203,762 | A | 4/1993 | Cooperstein | |
| 5,306,225 | A | 4/1994 | Miyano et al. | |
| 5,403,260 | A | 4/1995 | Hensley | |
| 5,643,169 | A | 7/1997 | Leung et al. | |
| 5,653,674 | A | 8/1997 | Leung | |
| 5,681,256 | A | 10/1997 | Nagafuji | |
| 6,440,316 | B1 | 8/2002 | Yoon et al. | |
| 6,572,524 | B1 | 6/2003 | Caldwell | |
| 7,261,683 | B2 | 8/2007 | Carr | |
| 2007/0114161 | A1 | 5/2007 | Carr | |

* cited by examiner

*Primary Examiner* — Jiping Lu
(74) *Attorney, Agent, or Firm* — Luedeka, Neely & Graham, PC

(57) ABSTRACT

A centrifugal bowl separator, including a bowl, a source of pressurized gas in selective flow communication with the bowl and operable to selectively supply pressurized gas to an interior portion of the bowl, and first and second pressure seals selectively established to provide a zone within a portion of the bowl such that when the pressurized gas is introduced, pressure within the portion of the bowl increases for enhanced removal of moisture and drying of solids within the portion of the bowl.

2 Claims, 13 Drawing Sheets

HYPERBARIC CENTRIFUGE SYSTEM

CROSS-REFERENCE TO RELATED APPLICATION

This is a divisional application to U.S. application Ser. No. 12/114,972 filed May 5, 2008 now U.S. Pat. No. 7,908,764, entitled "Hyperbaric Centrifuge System."

FIELD

This disclosure relates to the field of centrifugal separators. More particularly, this disclosure relates to centrifugal separator systems and methods incorporating elevated and selectively applied interior pressures to reduce the moisture content of the solid product yield.

BACKGROUND

Centrifugal separators are used for separating solids from liquids. For example, coal slurry primarily contains coal solids and water. A centrifugal separator is useful for separating the coal solids from the water and for further drying of the removed solids.

The value of the yielded solids is dependent upon the dryness of the solids. Thus, it is desirable to have an economical way to reduce the moisture content of the solids. The present disclosure relates to centrifugal separation methods and apparatus which enable reduced moisture content of separated solids as compared to what is achieved using conventional centrifugal separation methods and apparatus.

SUMMARY

The above and other needs are met by a centrifugal bowl separator, including a bowl; a source of pressurized gas in selective flow communication with the bowl and operable to selectively supply pressurized gas to an interior portion of the bowl; and first and second pressure seals selectively established to provide a zone within a portion of the bowl such that when the pressurized gas is introduced, pressure within the portion of the bowl increases for enhanced removal of moisture and drying of solids within the portion of the bowl.

In another aspect, the disclosure relates to a centrifugal separator for receiving a feed containing liquids and solids, separating liquids from solids, and drying removed solids. The separator includes a rotatable bowl having a solid portion for centrifugally separating liquids and solids and located adjacent an entrance end of the bowl configured for receiving the feed, and a slotted portion for drying solids and located adjacent an exit end of the bowl configured for discharging dried solids; a rotatable conveyor is operable to advance solids from the entrance end of the bowl toward the exit end of the bowl; a source of pressurized gas in selective flow communication with an interior portion of the slotted portion of the bowl and operable to selectively supply pressurized gas to the interior portion of the slotted portion of the bowl; a first sealing structure located adjacent the exit end of the bowl and operable to selectively block passage of solids from the slotted portion of the bowl through the exit end and thereby selectively establish a first pressure seal at the exit end of the bowl when the source of pressurized gas is supplying pressurized gas to the interior portion of the slotted portion of the bowl; and a second sealing structure located within the bowl for interacting with liquids pooled within the solid portion of the bowl for establishing a second pressure seal when the source of pressurized gas is supplying pressurized gas to the interior portion of the slotted portion of the bowl.

When the first and second pressure seals are established they provide a zone within the slotted portion of the bowl such that when the pressurized gas is introduced within the interior portion of the slotted portion of the bowl, pressure within the slotted portion of the bowl increases for enhanced removal of moisture and drying of solids within the slotted portion of the bowl.

In yet another aspect, the disclosure relates to a method of operating a separator having a rotating bowl and a rotating conveyor for treating a slurry to separate solids from liquids and for further drying of the solids.

The method includes the steps of operating the separator at a first operating condition in which the rotational speed of the conveyor is maintained greater than the rotational speed of the bowl; introducing feed into the bowl during the first operating condition so that a layer of solids builds on a sidewall of the bowl to produce a modulation torque; slowing rotation of the conveyor until the rotational speed of the bowl and the conveyor is the same; maintaining the rotational speed of the bowl and the conveyor at the same speed while supply pressurized gas to an interior portion of the bowl and establishing first and second seals to provide increased pressure within the interior portion of the bowl for enhanced drying of solids within the interior portion of the bowl; increasing the speed of the conveyor to establish a differential speed between the bowl and the conveyor; and maintaining the differential speed for a predetermined number of revolutions to remove dried solids.

Various steps may be repeated to provide continuous operation of the separator.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
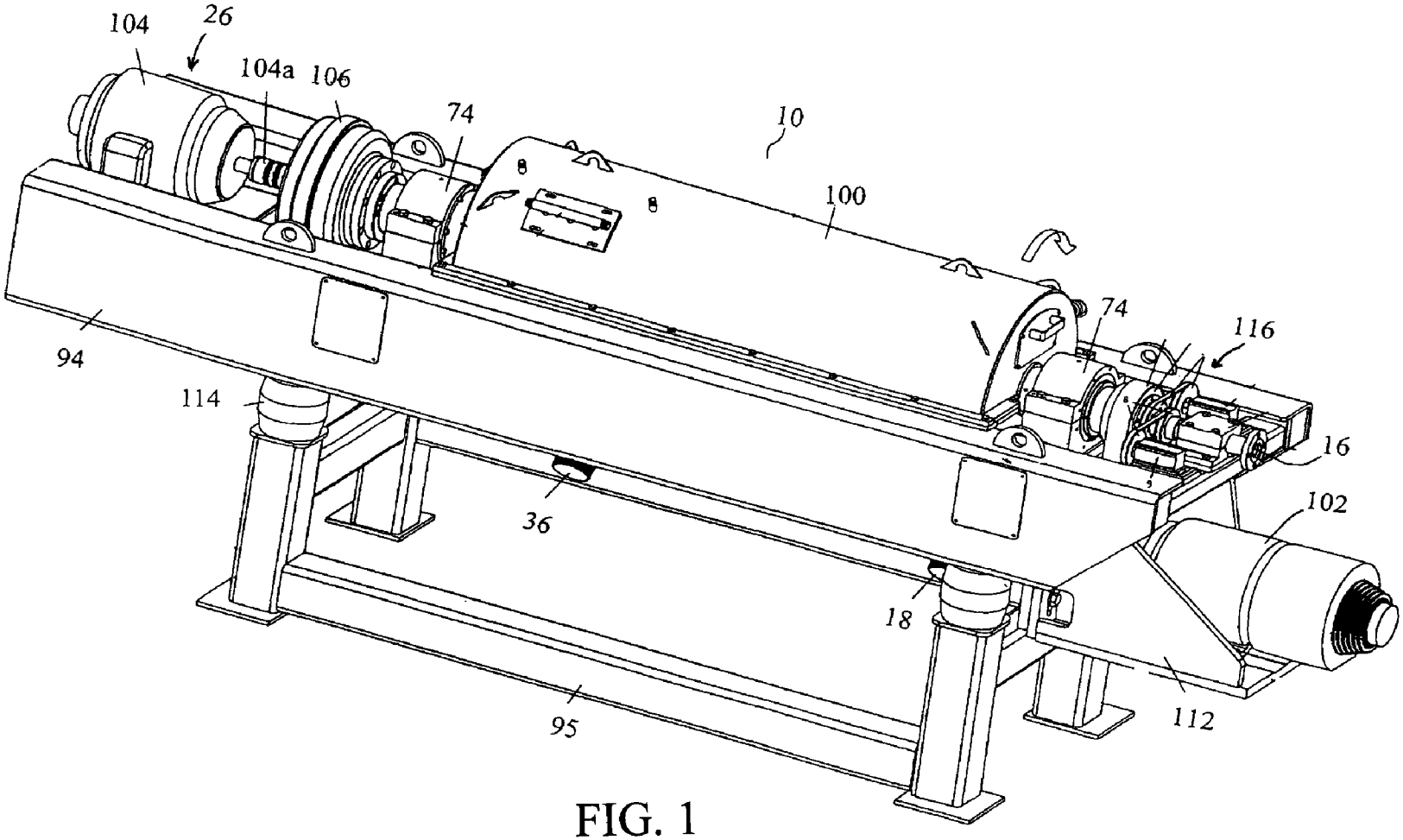
FIG. 1 is a perspective view of a centrifugal separator according to the disclosure.
Figure 2:
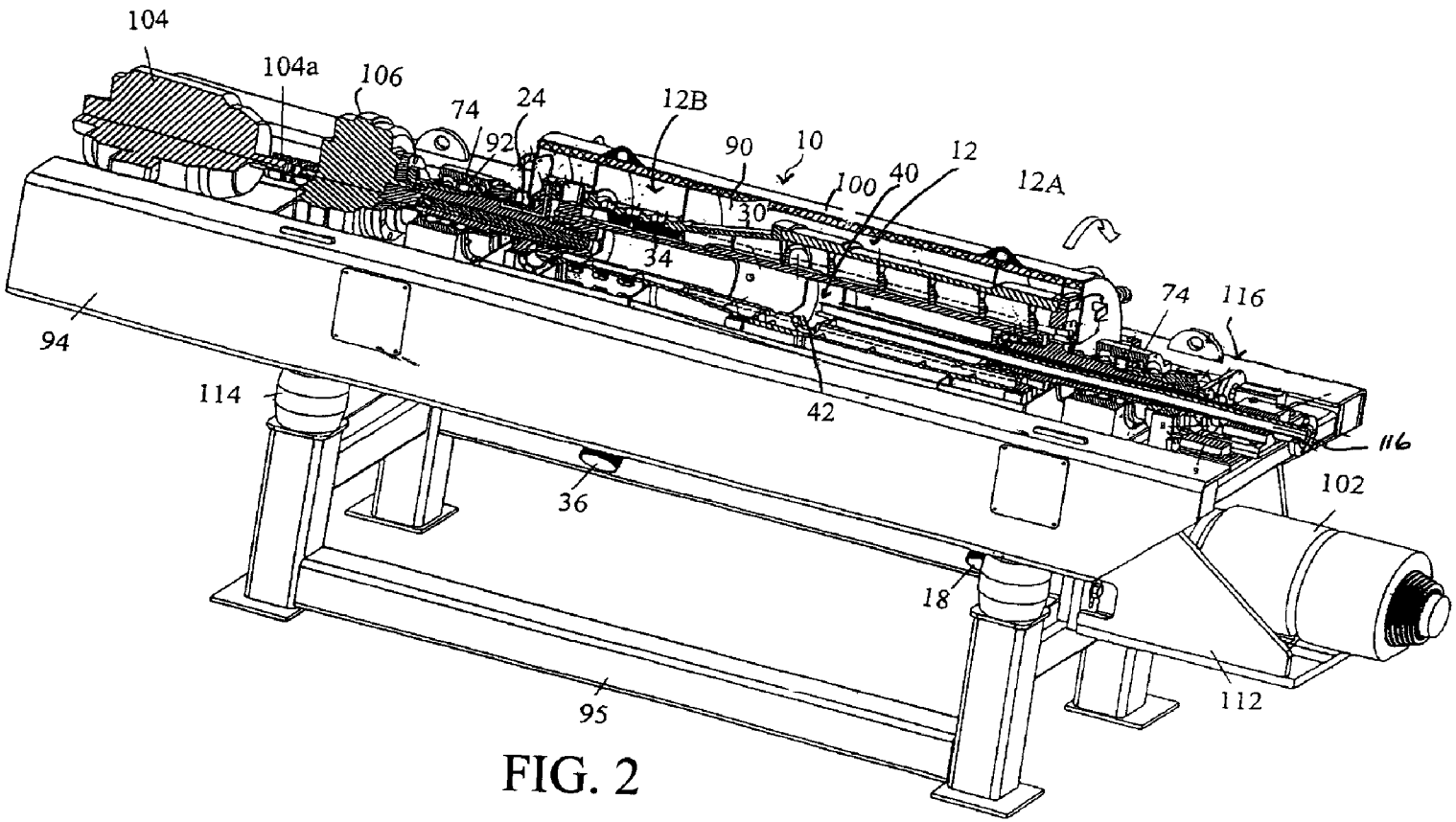
FIG. 2 shows the separator of FIG. 1 with portions thereof in cross-section.

The disclosure relates to centrifugal separator systems and methods incorporating elevated interior pressures to reduce the moisture content of the solid product yield of a slurry. Slurry in the form of a fluidized mixture of solids, such as coal, and liquids, such as water, is a slurry with which the separator has been observed to be useful.

For the purpose of example only, the separator systems and methods are described herein in and configured herein for use with coal slurries. However, it will be understood that the systems and methods may be configured to handle other solids/liquids mixtures, with the sizes, times, and the like selected for such mixtures.

The described coal slurry used as an example herein has from about 3 percent and 35 percent by weight coal solids. The solids generally have a particle size smaller than 325 Tyler mesh (44 micron), but having some solids of up to about 20 Tyler mesh (841 micron). The sizes and description herein of the separator systems is provided as an example for handling a feed rate of the described coal slurry of from about 30 to about 50 gpm, to yield product having a moisture content of less than about 25 weight percent. While the description herein contemplates a continuous slurry feed, it will be understood that separation may also be accomplished on a batch basis.

It has been observed that conventional centrifugal separators yield coal solids having a moisture content of about 35 wt. percent or more, whereas a centrifugal separator according to the disclosure yields coal solids having a moisture content of about 25 wt. percent or less.

In a preferred embodiment, and with initial reference to FIGS. 1-8, a centrifugal separator 10 is configured generally horizontally and includes a rotatable bowl 12 having a solid portion 12A and a screen portion 12B, and an independently rotatable screw conveyor 14 to convey solids through the bowl 12. A slurry S having liquid and solids is introduced via a feed conduit 16 and the separator 10 is operated to centrifugally separate liquids and solids and to further dry the solids. Liquids are primarily discharged via a liquid discharge port 18.

Solids are conveyed by the screw conveyor 14 across the screen portion 12B of the bowl 12 for further drying and for subsequent discharge via a solids discharge chute 20 fed by a plurality of discharge ports 22 located at the terminal end of the bowl 12. As described more fully below, during a pressurized operation or hyperbaric mode, rotation of the bowl 12 and the conveyor 14 are controlled so that the discharge ports 22 are blocked, and a pressurized gas is introduced into the bowl 12 for enhanced drying of the solids.

Operational steps, including blocking of the ports 22 and other structural and operational aspects of the conveyor 10 described below, together with the introduction of the pressurized gas, has been observed to provide enhanced drying of solids. Following the pressurization mode, rotation of the bowl and rotation of the screw conveyor 14 are controlled so that the ports 22 are unblocked and dried product is discharged, with discharge of solids assisted by pressurized gas exiting the separator 10. Delivery of pressurized gas is provided by a gas delivery system 24. The rotation of the bowl 12 and the rotation of the screw conveyor 14 are enabled by a rotation system and controlled by a drive system, collectively providing a centrifuge backdrive system 26.

In basic construction, the bowl 12 is generally conical in shape with the solid portion 12A having a larger diameter that the slotted portion 12B. During use, the bowl 12 rotates at a rate generally producing from about 2000 to about 3,500 g-force, as measured at the inner diameter of the bowl 12.

The terms "solid" and "slotted" are used herein for ease of reference and are to be understood in their normal meaning in regards to centrifugal separators. That is, the solid section has a substantially fluid impermeable sidewall and the slotted portion has a substantially fluid permeable sidewall, but is not necessarily configured with slots.

For handling a continuous coal slurry feed rate of from about 30 to about 50 gpm, the solid portion 12A has a substantially uniform diameter of from about 14 to about 18 inches and a length of from about 31 to about 33 inches. The slotted portion 12B has a substantially uniform diameter of from about 10 to about 12 inches and a length of from about 10 to about 12 inches. However it will be understood that other configurations and diameters may be utilized. The bowl 12 also may include a sloped beach section 30 as a transition between the solid portion 12A and the slotted portion 12B. The beach section 30 is also preferably solid and has a length of from about 13 to about 14 inches, its diameter uniformly changing (e.g., a constant slope) along its length between the solid portion 12A and the slotted portion 12B.

Examples of suitable materials for the solid portion 12A and the beach section 30 include stainless steel, duplex stainless steel, carbons steels, and alloy carbon steels.

Figure 3:
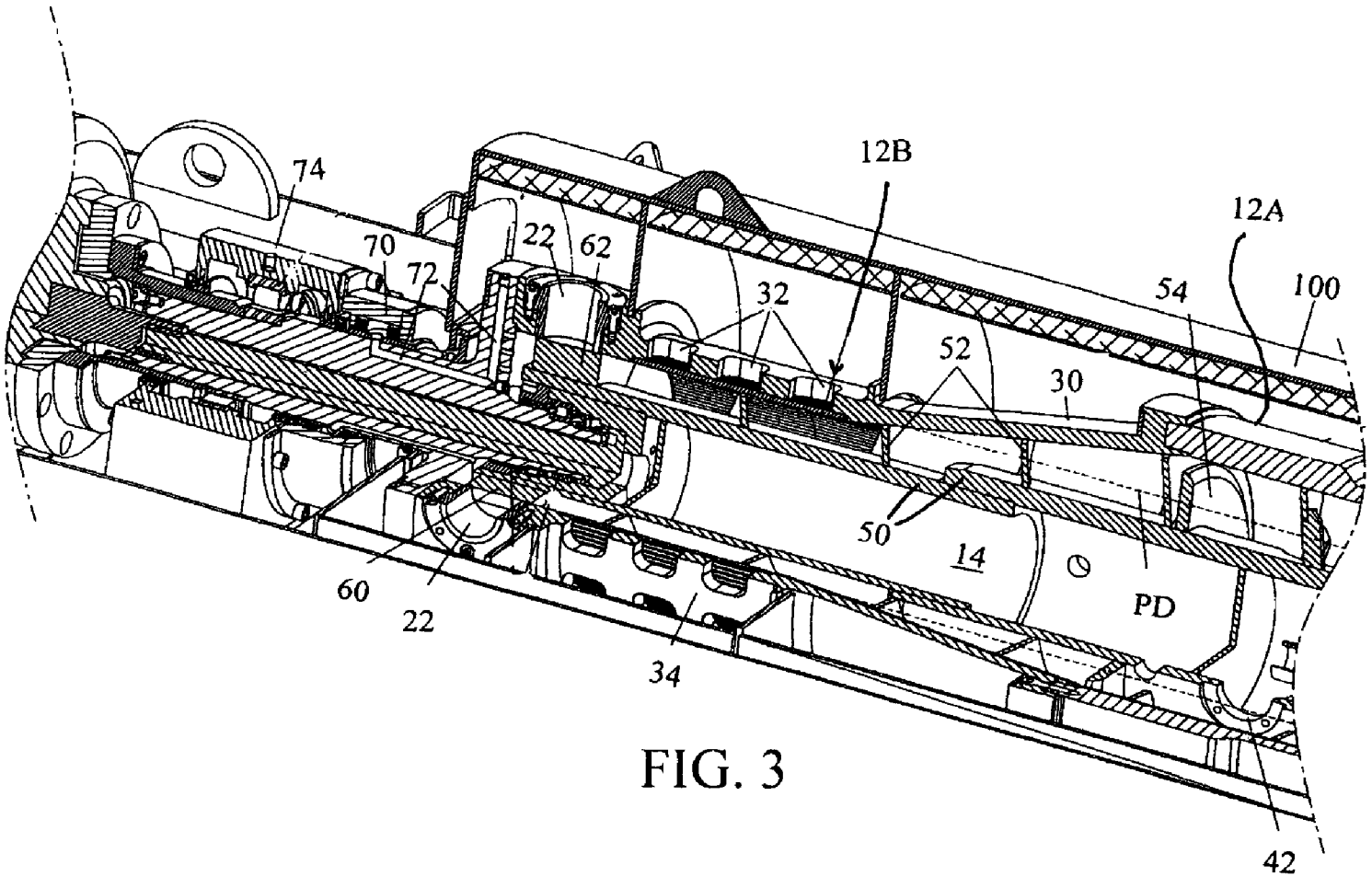
FIG. 3 is an enlarged perspective view of a solids discharge portion of the separator of FIG. 2.
Figure 4:
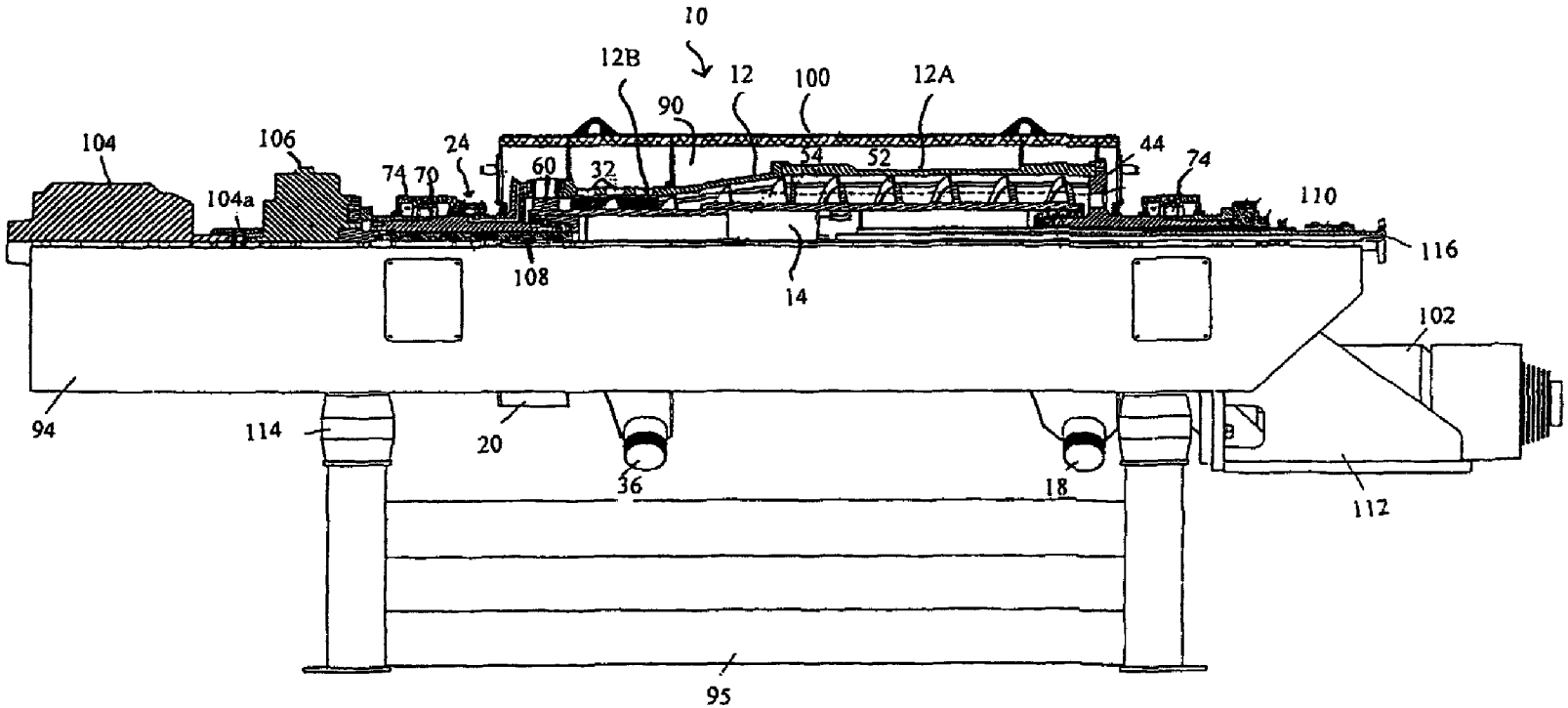
FIG. 4 is a right side view of the separator of FIG. 2.

With reference to FIG. 3, the slotted portion 12*b* is configured to have a fluid permeable sidewall and includes a plurality of uniformly spaced openings 32 and a screen 34 along the length of the slotted portion 12B. The slotted portion 12B is made of a frame made of the same material as the solid portion 12A and the beach section 30, with the frame configured to provide the openings 32 as 2 inch square or 2 inch diameter circular openings for use with the described coal slurry. The screen 34 is located interior the frame adjacent the openings 32. Suitable materials to provide the screen 34 include tungsten carbide bars, alumina ceramic, wedge wire, or the like materials. For use with the described coal slurry, the screen 34 preferably provides openings of from about 0.004 to about 0.035 inches. However, it will be understood that the openings 32 and the screen 34 may be otherwise dimensioned for various applications and that the slotted portion 12B could be otherwise configured to provide a fluid permeable sidewall. During use of the separator, moisture removed from the solids (and any solids fines small enough to pass through the screen 34) passes through the screen 34 and the openings 32 and is directed to a drain 36 for discharge.

Returning to FIG. 2, the slurry S enters the separator 10 via the feed conduit 16, with the feed conduit 16 terminating at a feed compartment 40. Slurry flows from the feed compartment 40 through a plurality of feed ports 42 into the solid portion 12A of the bowl 12. Centrifugal forces from rotation of the bowl 12 causes separation of solids from liquids in the solid portion 12A. Solids tend to move toward the sidewall of the solid portion 12A, and liquids tend to move toward the center of the solid portion 12A of the bowl due to rotation of the bowl 12. As the slurry S continues to enter (continuous feed), the liquid level rises and spills over an annular end wall 44 of the solid portion 12A located at the proximal end of the solid portion 12A. Liquid that spills over the end wall 44 is discharged via the liquid discharge port 18.

Solids are conveyed by the screw conveyor 14 through the beach section 30, through the slotted portion 12A for drying, and then through the ports 22 for discharge via the chute 20. As described below, compressed gas, such as air, is selectively introduced into the slotted portion 12A by the gas delivery system 24 to selectively provide a zone of high pressure in the slotted portion 12B which enhances drying of the solids beyond that supplied by centrifugal force from rotation of the slotted portion 12B. Moisture exits the slotted portion 12B (and solids fines) passes through the screen 34 and the openings 32 and is directed to the drain 36.

Figure 5:
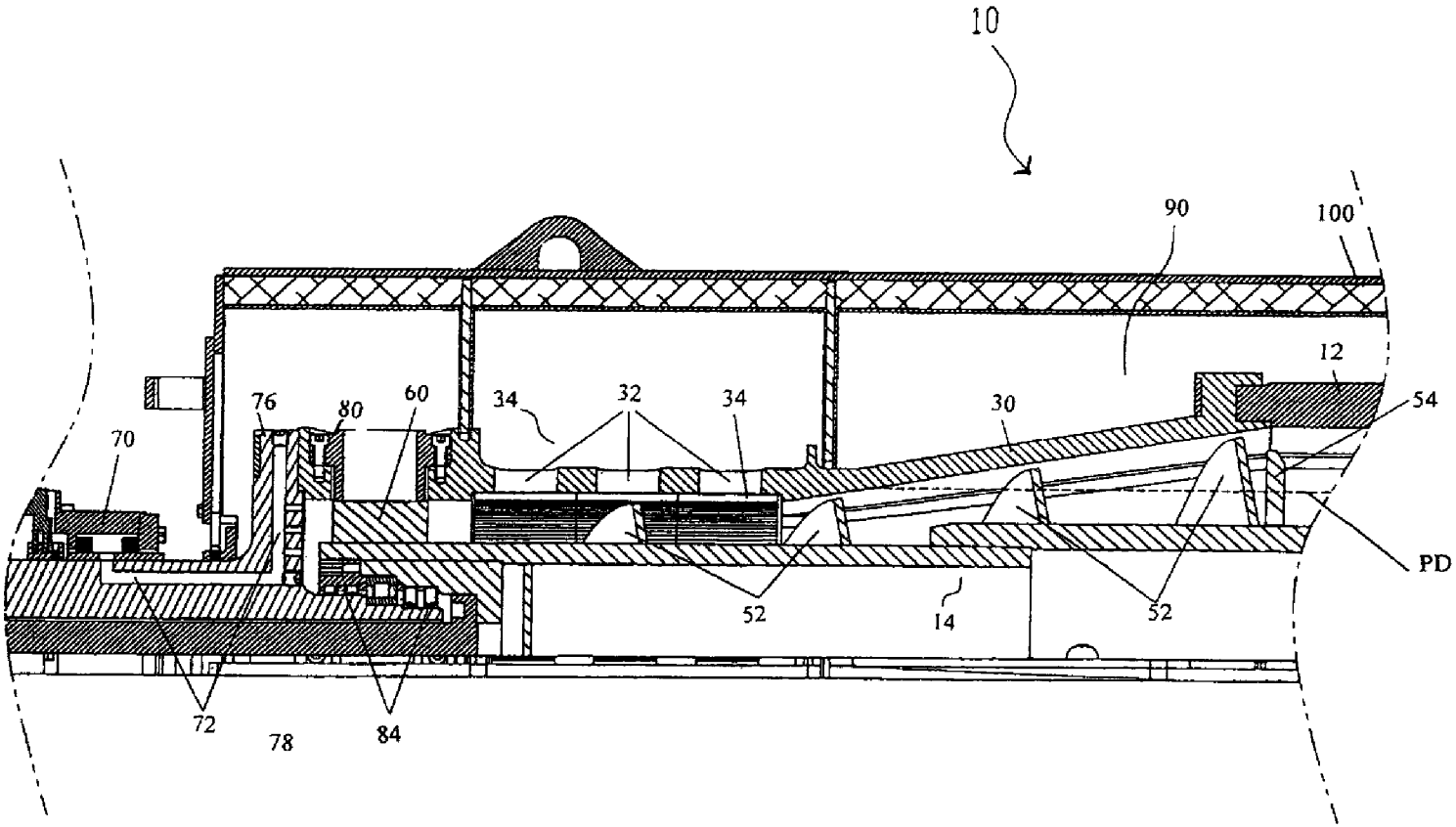
FIG. 5 is an enlarged side view of the solids discharge portion of FIG. 3.
Figure 6:
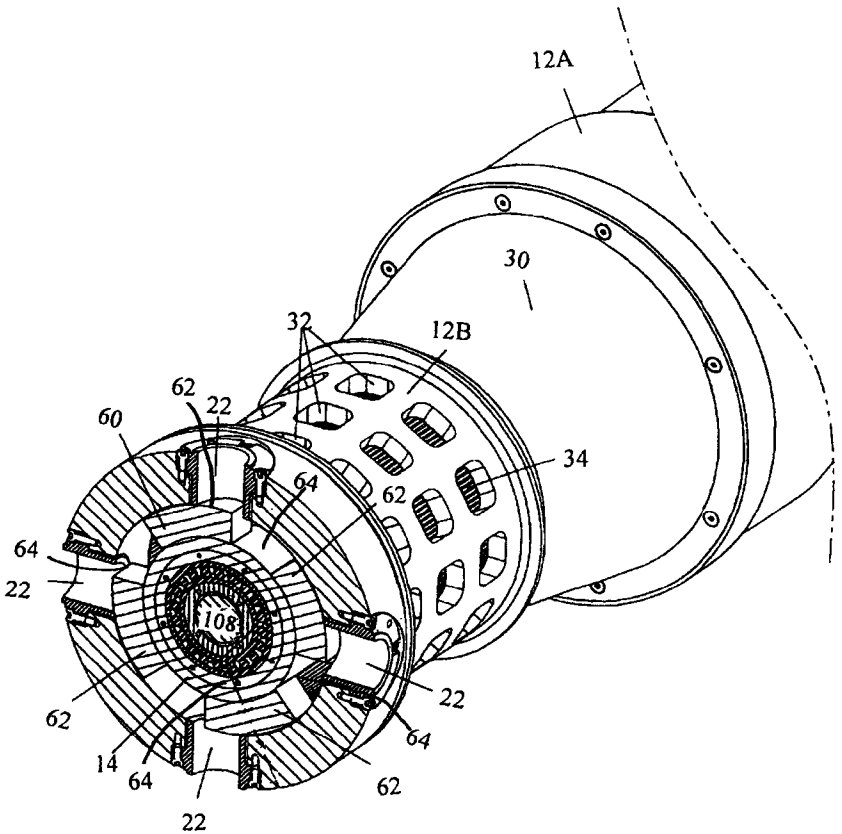
FIG. 6 is a perspective cross-sectional end view of portions of the solids discharge portion of FIG. 5.
Figure 12:
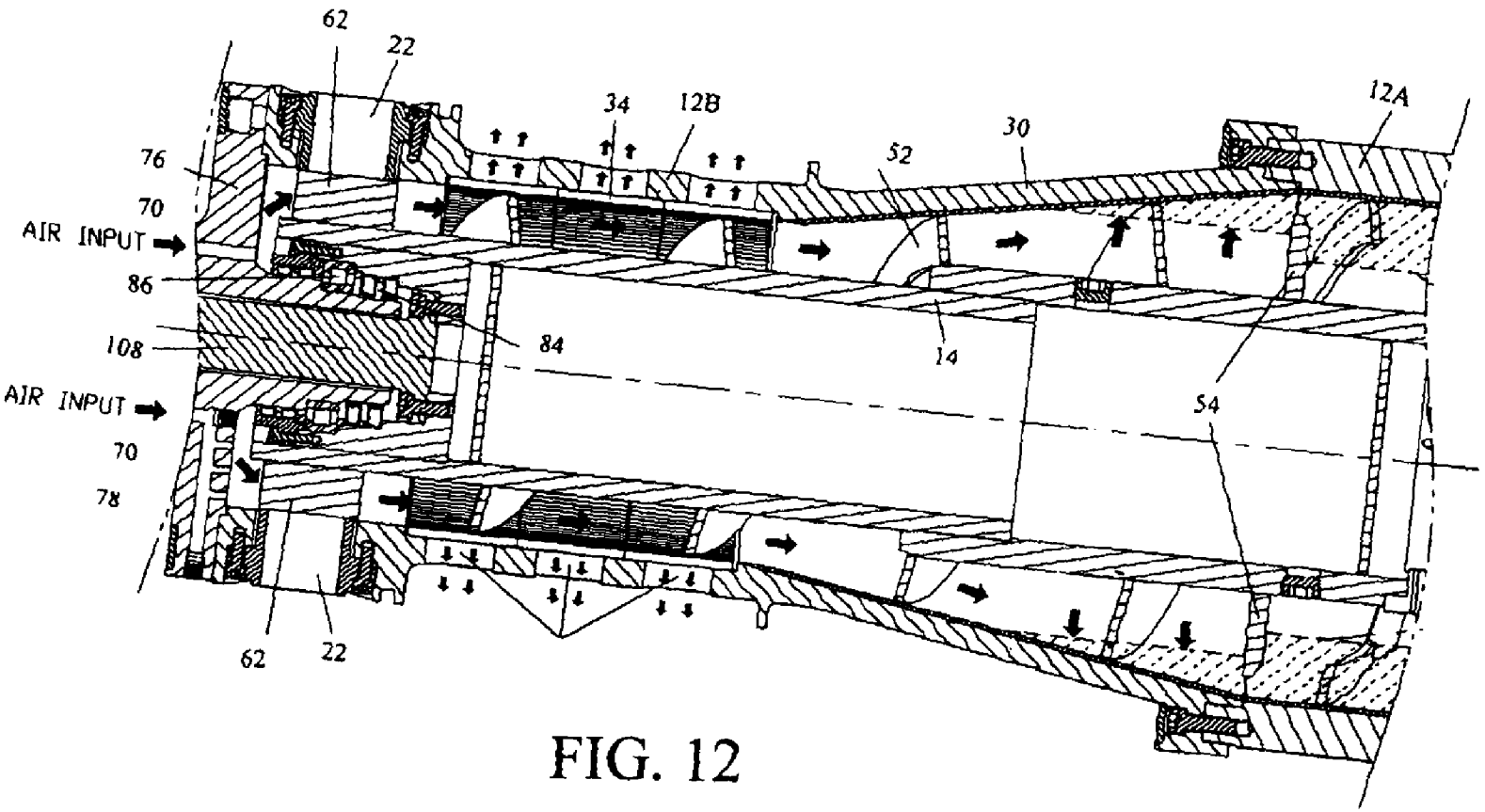
FIG. 12 shows operation of the separator with the solids discharge ports blocked during a pressurized operation mode of the separator.

The screw conveyor 14 is made of a durable, rigid material such as stainless steel or the like and includes an elongate barrel 50 having flights provided by a helical blade 52 configured to convey solids, such as coal solids, through the separator 10. The screw conveyor 14 is generally of conventional construction, except that it is modified to include a dip weir 54 (FIGS. 5 and 12). The dip weir 54 is provided as an annular baffle attached, as by welding, to the screw conveyor 14. The dip weir 54 is located coaxial with the barrel 50 and extends radially such that an outer diameter 46 of the dip weir 54 engages a pool of the slurry S within the solid portion 12A of the separator 10 (FIG. 12).

Figure 11:
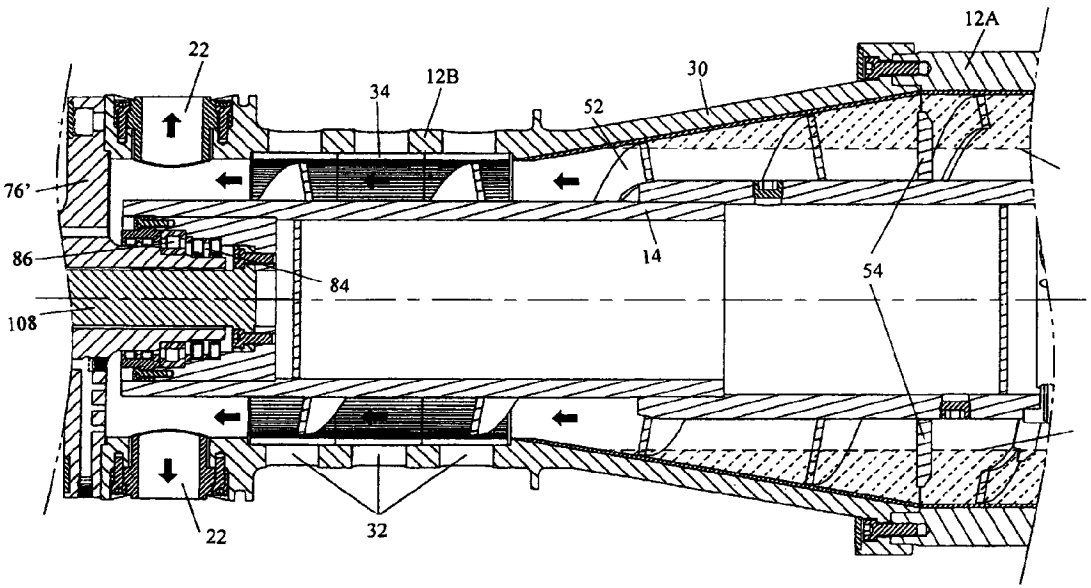
FIG. 11 shows operation of the separator to discharge solids.

The dip weir 54 is desirably located proximate the solids discharge side of the incoming feed so as to be adjacent the beach section 30 of the bowl 12, preferably at the entrance end of the beach section 30, as shown in FIG. 5. The presence of the dip weir 54 causes the level of liquid or pool depth PD (FIGS. 11 and 12) to adjust during application of pressure to the slotted portion 12B, so that the hydrostatic pressure of the liquid levels on both sides of the dip weir 54 are balanced. In this manner, the dip weir 54 serves as a boundary of the zone of increased pressure when pressurized gas is applied to the slotted portion 12B, such that an effective seal is provided adjacent the entrance end of the slotted portion 12B during pressurization. The precise location and dimension of the dip weir 54 may vary corresponding to the slurry treated.

The ports 22 are selectively blocked during a pressurization or hyperbaric mode to provide as a boundary or pressure seal at the opposite end of the slotted portion 12B such that the portion of the bowl 12 between the dip weir 54 and the blocked ports 22 experiences increased pressure when pressurized gas is supplied. In this regard, and with additional reference to FIGS. 6-8, a terminal portion of the screw conveyor 14 includes a discharge lobe 60 configured to selectively block the discharge ports 22 during a first relative orientation of the screw conveyor 14 and the bowl 12, and to not block the discharge lobes 22 during a second relative orientation of the conveyor 14 and bowl 12.

Figure 7:
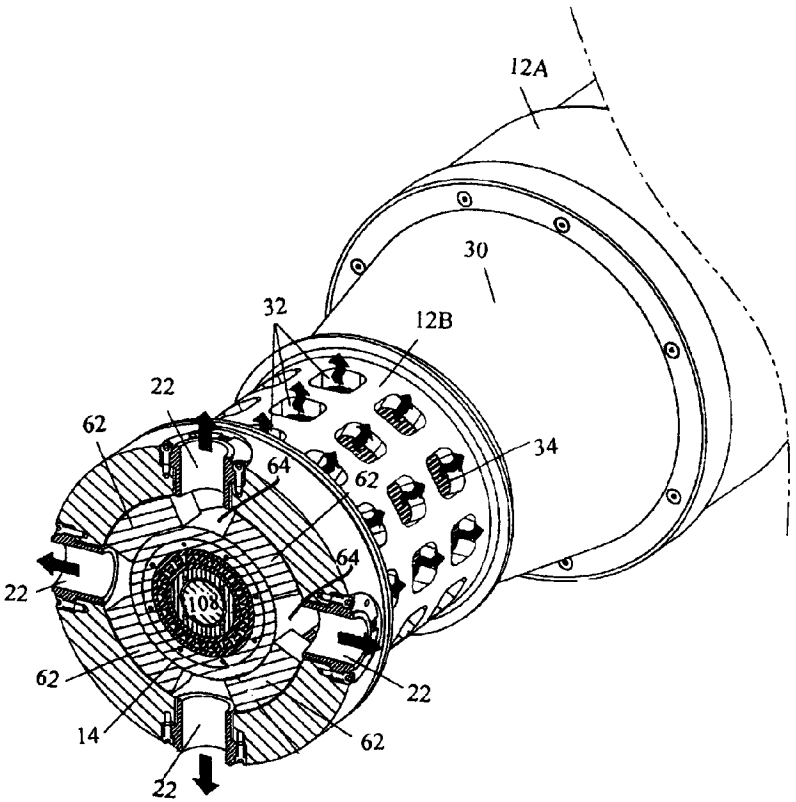
FIG. 7 is the figure of FIG. 6 having arrows added to show discharge routes of dried product and removed moisture during a non-pressurized operation mode of the separator.
Figure 8:
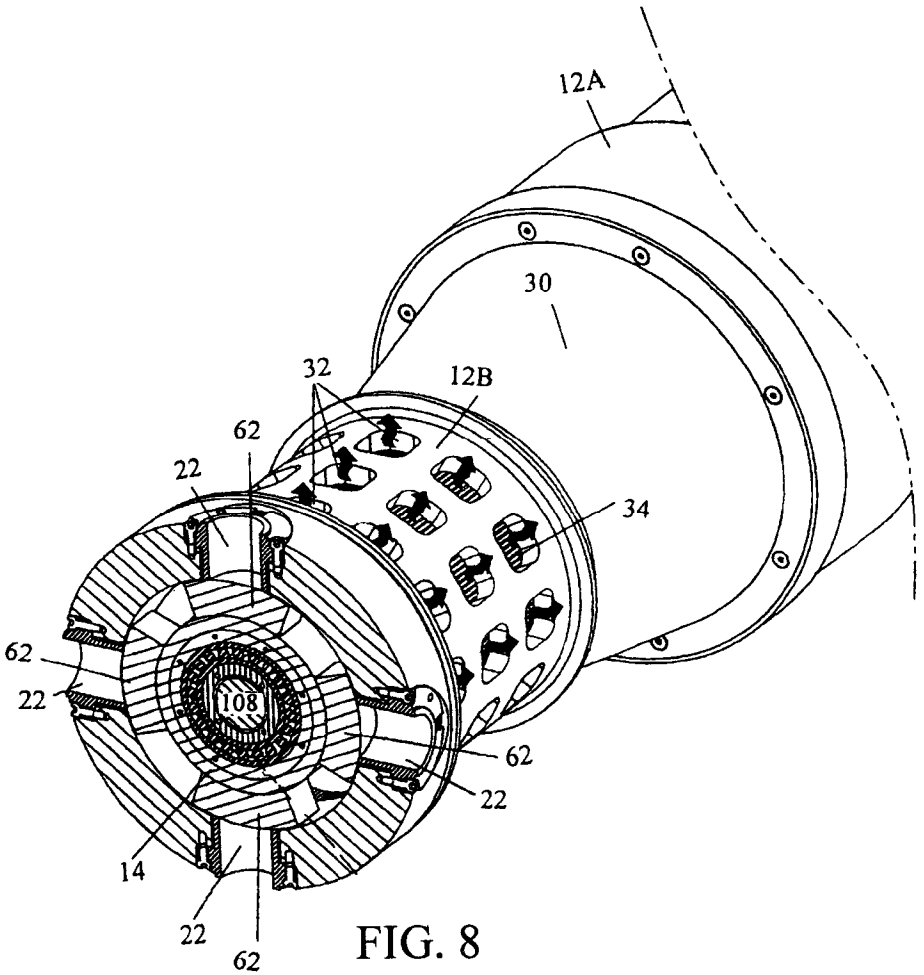
FIG. 8 is the figure of FIG. 7 showing the solids discharge ports blocked during a pressurized operation mode of the separator.
Figure 9:
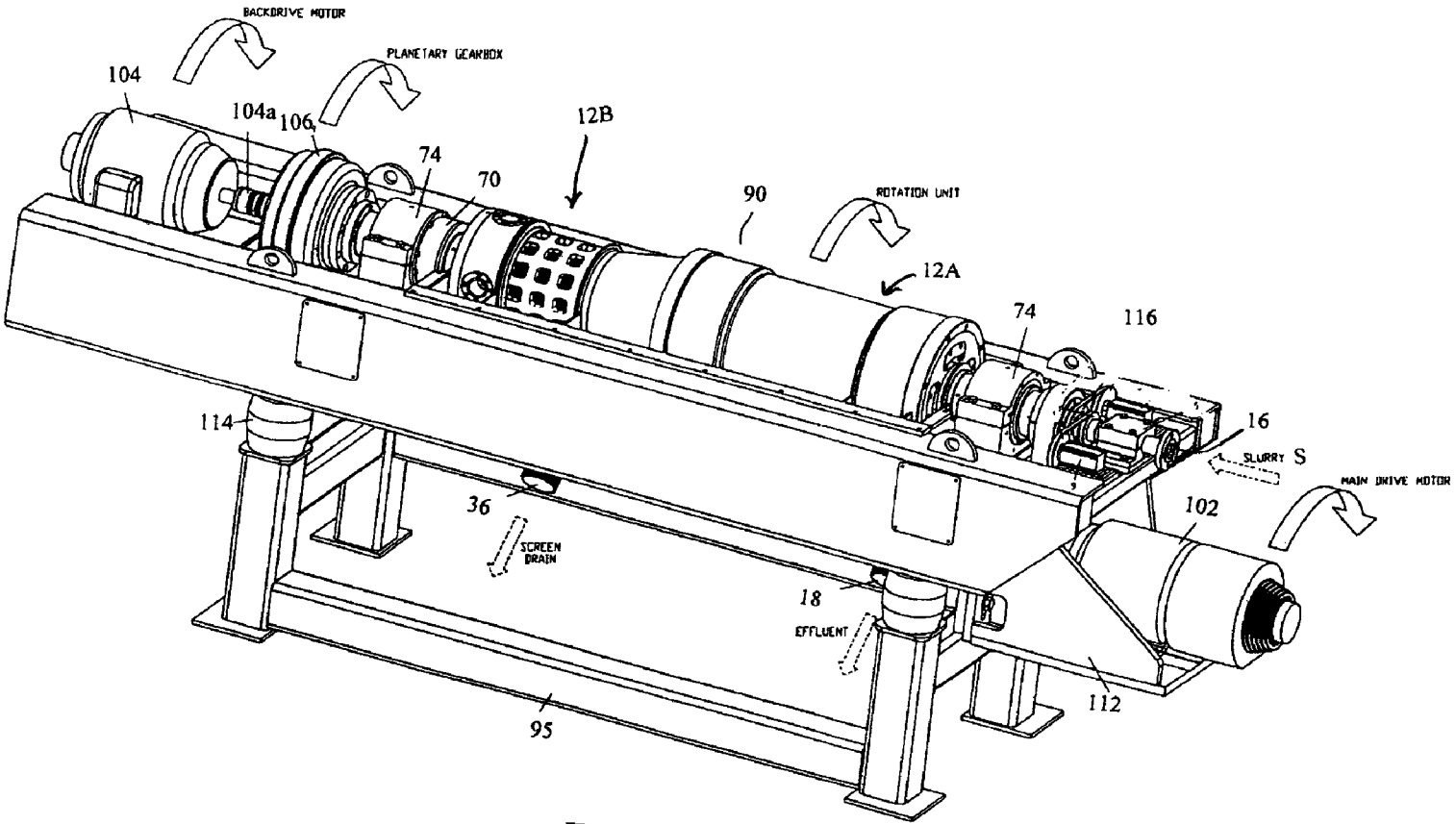
FIG. 9 shows operation of the drive system of the separator of FIG. 1 in a hyperbaric mode.
Figure 10:
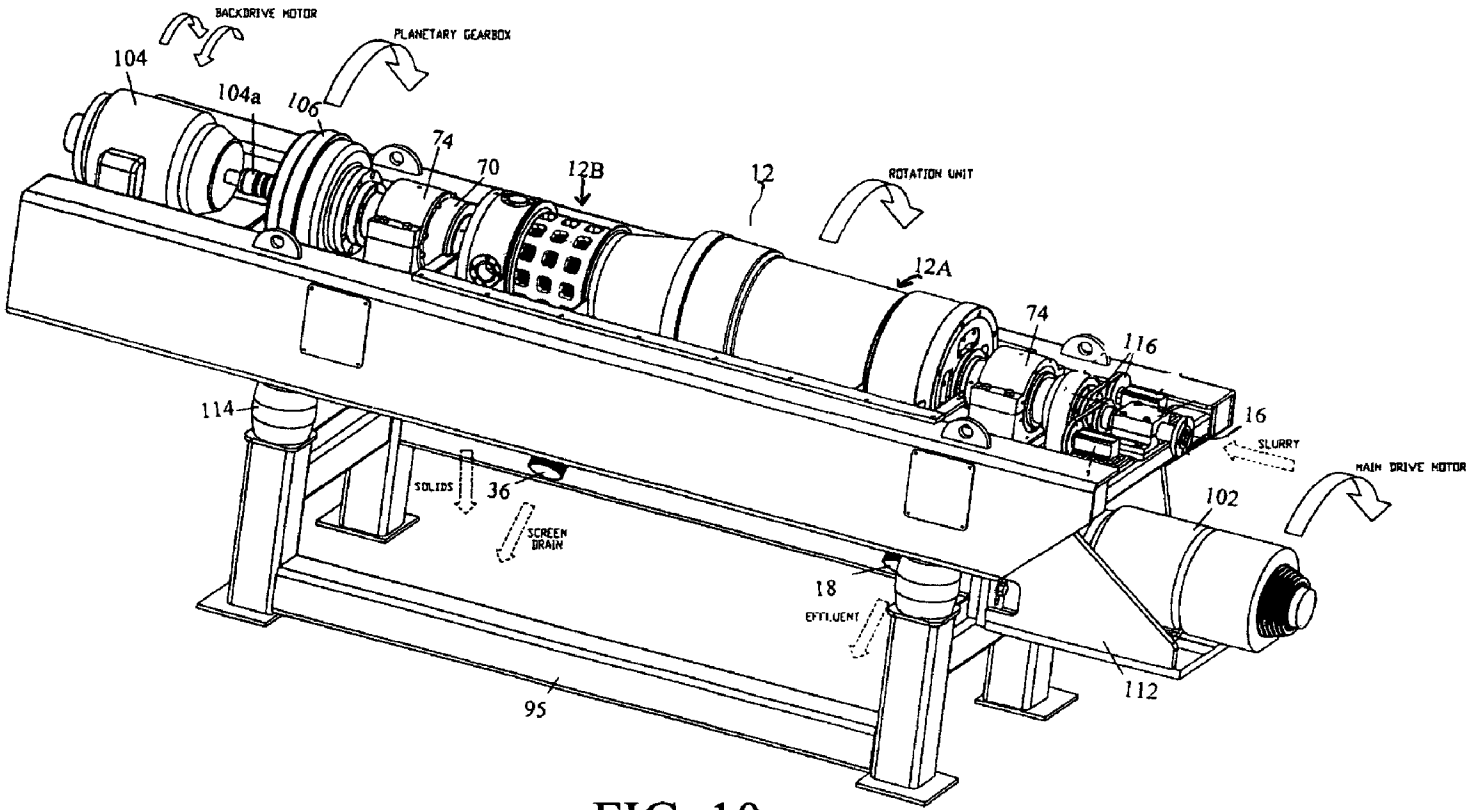
FIG. 10 shows operation of the drive system of the separator of FIG. 1 in a conveyance and setting of coincidence mode.

As shown, four of the ports 22 are uniformly spaced, and the discharge lobe 60 is configured to have four corresponding blocking surfaces 62 separated by open areas 64. FIG. 7 shows the first relative orientation of the screw conveyor 14 and the bowl 12, with the open areas 64 aligned with the ports 22 so that the ports are not blocked. FIG. 8 shows the second relative orientation of the screw conveyor 14 and the bowl 12, with the blocking surfaces 62 aligned with the ports 22 so that the ports are blocked.

The relative orientation and hence blocking/unblocking of the ports 22, is accomplished by the centrifuge backdrive system 26. When the discharge ports 22 are blocked, pressure is introduced by the gas delivery system 24 to provide the hyperbaric mode. Discharge of the dried solids is then accomplished by unblocking the ports 22, with the discharge of solids desirably assisted by pressurized gas exiting the separator 10 through the ports 22.

For example, during the conveyance of the dried solids, immediately following the hyperbaric mode, it has been observed that sufficient pressure remains in the slotted section 12B to assist the discharge of dried solids. As the lobe 39 is rotated to unblock the ports 22, dried solids are generally adjacent and at least partially blocking the ports 22. It has been observed that as the pressurized gas begins to exit the slotted portion 12B through the ports 22, at least a significant portion of the dried product is rapidly conveyed from the slotted portion 12B through the ports 22 with the exiting gas, thus providing enhanced discharge characteristics beyond that provided by the screw conveyor 14 and centrifugal forces.

Figure 13:
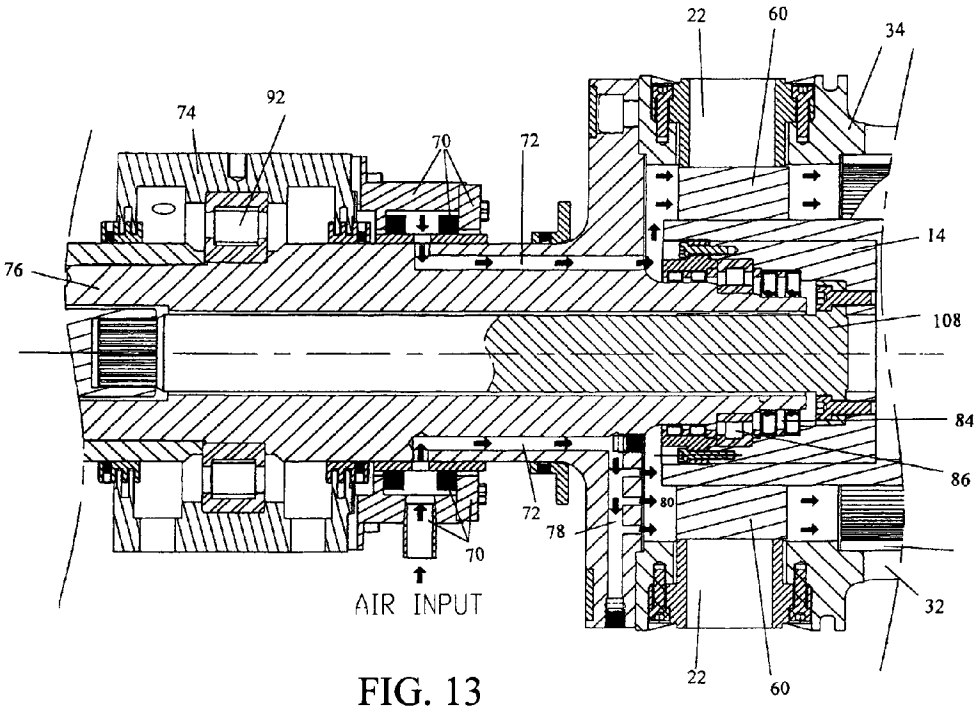
FIG. 13 is a cross-sectional side view of a portion of the separator of FIG. 1 showing introduction of pressurized gas to the separator.

With additional reference to FIGS. 5, 12, and 13, the gas delivery system 24 includes a gas input seal assembly 70 in flow communication with gas passages 72 for introducing pressurized gas into the interior of the slotted portion 12B of the bowl 12 during operation of the separator in the hyperbaric or pressurized mode. The gas input seal assembly 70 is non-rotating and provides a stationary platform for routing of pressurized gas.

The seal assembly 70 is located on one of the pillow blocks 74 associated with the backdrive system 26. Pressurized gas is introduced into the assembly 70 from an external source of pressurized gas and is routed by the assembly 70 to the passages 72. The passages 72 extend into a rotatable headwall 76 of the slotted portion 12B of the bowl 12. The interior surface of the headwall 76 includes a plurality of apertures 78 in flow communication with the passages 72 for distributing pressurized gas to the interior of the slotted portion 12B of the bowl 12. The apertures 78 are axially arranged and feed distribution openings 80 which allow the pressurized gas to exit the headwall 76 and pressurize the slotted portion 12B of the bowl 12. Conveyor gaskets or seals 84 are located to seal against travel of fluids, solids, and pressure from the bowl 12 to the conveyor screw 14 adjacent conveyor bearings 86.

With additional reference to FIGS. 2, 4, 9 and 10, the centrifuge backdrive system 26 includes a rotation unit 90 mounted on main bearings 92 within the pillow blocks 74 (noted previously) mounted on a base frame 94 (supported by a sub frame 95) and enclosed within a housing 100. The system 26 also includes a main drive motor 102, a backdrive motor 104 and backdrive coupling 104*a*, a planetary gearbox 106 connected to both the bowl 12 and the screw conveyor 14, drive trunion 108, feed trunion 110, main motor adjusting plate 112, vibration isolators 114, and associated control electronics and drive mechanisms, such as belts, sheaves, bearings, and the like commonly used on centrifugal screenbowl separators, generally indicated by reference numeral 116.

The main drive motor 102 and the backdrive motor 104 are preferably alternating current (AC) electric motors having an adjustable speed drive system, preferably a variable-frequency-drive (VFD) system, for controlling the rotational speed of the motors by controlling the frequency of the electrical power supplied to the motors. The main drive motor 102 functions to bring the rotational unit 90 to operational speed and maintain a predetermined speed. The backdrive motor 104 works in conjunction with the planetary gearbox 106 to control the rotation of the screw conveyor 14, and hence the differential speed of the bowl 12 and the conveyor 14, and to also thereby control the position the conveyor 14 relative to the bowl 12. The VFD system associated with the backdrive motor 104, typically operating in a regenerative torque mode, is in electrical communication with the VFD system of the main motor 102. In this regard, it is understood that drive torque is that required to rotate, whereas regenerative torque is that which must be absorbed to maintain rotation at the prescribed speed when it wants to rotate faster.

Preferred motors for providing the main drive motor 102 and the back drive motor are available from Baldor Electric Company of Fort Smith, Ark., as follows:

| Main drive motor | Back drive motor |
|---|---|
| Baldor 15 hp, inverter duty, 4-pole, 1800 rpm, with a maximum speed of 5000 rpm, 1000:1 torque turn down capability, 230/460 volt, 3 phase, NEMA frame size 256TC, totally enclosed blower cooled (TEBC), F1 foot mounted, insulation class H, NEMA starting design code B | Baldor 7½ hp, inverter duty, 4-pole, 1800 rpm, with a maximum speed of 5000 rpm, 1000:1 torque turn down capability, 230/460 volt, 3 phase, NEMA frame size 256TC, totally enclosed blower colled (TEBC), F1 foot mounted, insulation class H, NEMA starting design code B. |

A preferred gearbox for providing the gearbox 106 is a two stage planetary unit available from Alfa Laval of Sweden, having a 2.2 kN output capacity, with a 159:1 input to output ratio.

The backdrive system 26 advantageously enables independent stopping, starting and rotation of the conveyor 14 and the bowl 12, and relative positioning of the conveyor 14 and the bowl 12. For example, as noted previously, accurate positioning of the conveyor 14 and the bowl 12 enables selective blocking or unblocking of the ports 22, and the relative rotation of the bowl 12 and conveyor 14 controls the travel rate of solids through the separator 10.

In basic operation of the separator 10, the backdrive motor 104 is started to produce a preset differential, such as about 10 rpm, between the screw conveyor 14 and the stationary bowl 12. The main motor 102 is then started to maintain a zero speed differential. This differential is maintained for a predetermined period of time, such as about 5 minutes, for cleaning of any residual material. At this point, the backdrive motor 104 is in an energy consumption mode.

The main drive motor 102 is started following the initial cleaning period and the bowl 12 is brought to a predetermined rotational speed, typically about 3760 rpm, with the conveyor 14 maintained at a differential speed as in the initial cleaning period. However, at this point the differential speed is not critical and may vary slightly, such as 2 to 3 rpm.

Once the bowl 12 is at the desired rotational speed, the backdrive system 26 provides a predetermined differential speed between the bowl 12 and the conveyor 14, such as from about 1 to about 3 rpm. The main motor 102 is in an energy consumption mode and the backdrive motor in a regenerative mode, with the conveyor 14 rotating from about 1 to about 3 rpm slower than the bowl 12. A feed ready state is indicated and feed of the slurry S is begun. Over the next few minutes a cake or layer of solids begins to build on the sidewall of the solid portion 12A of the bowl 12 and the backdrive motor 104 experiences an increase in the torque required to maintain the differential. The motor 104 is operated to maintain the conveyor 14 at a minimum differential speed and the speed varies between this minimum speed and a preset maximum based on input torque limits. Once the bowl 12 has sufficient cake to produce a modulation torque, a hyperbaric mode ready state is indicated. That is, once feed is established and torque from solids cake in the bowl 12 is present, the conditions are appropriate for enhanced drying of solids in the slotted portion 12B to begin according to the disclosure.

To initiate the enhanced drying or hyperbaric mode, the rotational differential of the bowl 12 and the conveyor is controlled to be zero. Rotation of the conveyor 14 is slowed at a desirable rate and rotational speed change is stopped when coincidence is detected between the bowl 12 and the conveyor 14. In this regard, coincidence is understood to refer to substantial alignment of the locking surfaces 62 of the lobe and the ports 22 so as to effectively seal the ports 22 so as to permit the slotted portion 12B to be pressurized by introducing a pressurized gas. Once this orientation is achieved, it is maintained for a predetermined period of time, such as from about 5 to about 8 seconds. During this time, the gas delivery system 24 is operated to deliver pressurized gas, such as air, to the slotted portion 12B. At the end of the pressurization period the speed of the conveyor 14 is adjusted to a predetermined differential speed, such as from about 10 to about 15 rpm faster than the bowl 12. This serves to unblock the ports 22 for release of pressure and solids as described previously. The conveyor 14 is maintained at this speed for a predetermined number of revolutions, for example about 2 revolutions, to remove dried solids and return to the previous synchronized position for a subsequent pressurization phase. This sequence continues repeatedly until cancelled by an operator.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A method for operating a separator having a rotatable bowl and a rotatable conveyor for treating a slurry to separate solids from liquids and for further drying of the solids, the method comprising the steps of:

operating the separator at a first operating condition in which the rotational speed of the conveyor is maintained greater than the rotational speed of the bowl;

introducing feed into the bowl during the first operating condition so that a layer of solids builds on a sidewall of the bowl to produce a modulation torque;

slowing rotation of the conveyor until the rotational speed of the bowl and the conveyor is the same;

maintaining the rotational speed of the bowl and the conveyor at the same speed while supply pressurized gas to an interior portion of the bowl and establishing first and second seals to provide increased pressure within the interior portion of the bowl for enhanced drying of solids within the interior portion of the bowl;

increasing the speed of the conveyor to establish a differential speed between the bowl and the conveyor; and maintaining the differential speed for a predetermined number of revolutions to remove dried solids.

2. A method for treating a slurry to separate solids from liquids and for further drying of the solids, the method comprising the steps of:

(a) providing a centrifugal separator, comprising:

a rotatable bowl having a solid portion for centrifugally separating liquids and solids and located adjacent an entrance end of the bowl configured for receiving a feed of the slurry, and a slotted portion for drying solids and located adjacent an exit end of the bowl configured for discharging dried solids, a rotatable conveyor operable to advance solids from adjacent the entrance end of the bowl to the exit end of the bowl, a pressurized gas system in selective flow communication with an interior portion of the slotted portion of the bowl and operable to selectively supply pressurized gas to the interior portion of the slotted portion of the bowl, a first sealing structure located adjacent the exit end of the bowl and selectively operable to block passage of solids from the slotted portion of the bowl through the exit end and thereby selectively establish a first pressure seal at the exit end of the bowl when the source of pressurized gas is supplying pressurized gas to the interior portion of the slotted portion of the bowl, a second sealing structure located within the bowl for interacting with liquids pooled within the solid portion of the bowl for establishing a second pressure seal when the source of pressurized gas is supplying pressurized gas to the interior portion of the slotted portion of the bowl, (b) operating the separator at a first operating condition wherein the rotational speed of the conveyor is maintained greater than the rotational speed of the bowl;

(c) introducing feed into the solid portion of the bowl during the first operating condition so that a layer of solids builds on a sidewall of the solid portion of the bowl to produce a modulation torque;

(d) after the bowl has a sufficient layer to produce the modulation torque, performing a hyperbaric drying phase by slowing rotation of the conveyor until the rotational speed of the bowl and the conveyor is the same and maintaining the rotational speed of the bowl and the conveyor at the same speed while operating the gas delivery system to supply pressurized gas to the interior portion of the slotted portion of the bowl and establishing the first and second seals to provide increased pressure within the slotted portion of the bowl for enhanced drying of solids within the slotted portion of the bowl;

(e) increasing the speed of the conveyor to establish a differential speed between the bowl and the conveyor substantially corresponding to the first operating condition of Step (b) and maintaining the differential speed for a predetermined number of revolutions to remove dried solids;

(f) repeating Steps (c) through (e) one or more times.

* * * * *